US009732768B2

(12) United States Patent
Ladouceur

(10) Patent No.: US 9,732,768 B2
(45) Date of Patent: Aug. 15, 2017

(54) INTERMITTENT FLUID PUMP

(71) Applicant: Richard Ladouceur, Hornby Island (CA)

(72) Inventor: Richard Ladouceur, Hornby Island (CA)

( * ) Notice: Subject to any disclaimer, the term of this patent is extended or adjusted under 35 U.S.C. 154(b) by 372 days.

(21) Appl. No.: 14/557,575

(22) Filed: Dec. 2, 2014

(65) Prior Publication Data

US 2015/0159676 A1 Jun. 11, 2015

(30) Foreign Application Priority Data

Dec. 10, 2013 (CA) ..... 2835789

(51) Int. Cl.

| | |
|---|---|
| ***F04F 1/00*** | (2006.01) |
| ***F04F 1/06*** | (2006.01) |
| ***F04F 1/18*** | (2006.01) |
| *F04B 19/00* | (2006.01) |

(52) U.S. Cl.

CPC ..... *F04F 1/06* (2013.01); *F04F 1/00* (2013.01); *F04F 1/18* (2013.01); *F04B 19/00* (2013.01)

(58) Field of Classification Search

CPC ..... F04F 1/00; F04F 1/18
USPC ..... 417/108
See application file for complete search history.

(56) References Cited

U.S. PATENT DOCUMENTS 1,339,137 A * 5/1920 Rodgers ..... F04F 1/18 261/77
1,741,571 A * 12/1929 Ives ..... F04F 1/00 417/108
2,317,121 A * 4/1943 Bowman ..... F04F 1/18 417/138
2,336,683 A * 12/1943 Hatfield ..... E21B 43/122 417/145
3,542,490 A * 11/1970 Gare ..... F04F 1/18 417/108
3,991,825 A * 11/1976 Morgan ..... F04F 1/06 166/106
4,625,801 A * 12/1986 McLaughlin ..... B09C 1/002 166/267
4,828,696 A * 5/1989 Makino ..... B01F 3/04113 210/170.06
5,014,789 A * 5/1991 Clarke ..... E21B 43/122 166/372

(Continued)

FOREIGN PATENT DOCUMENTS

EP 0033407 A1 8/1981

*Primary Examiner* — Charles Freay
*Assistant Examiner* — Christopher Bobish
(74) *Attorney, Agent, or Firm* — Davis & Bujold PLLC; Michael J. Bujold

(57) ABSTRACT

An intermittent fluid pump is disclosed wherein a gas is introduced into a fluid storage housing containing liquid. The gas is released intermittently from a fluid transfer housing via a fluid transfer passage into a vertically oriented fluid conveyance conduit thereby creating a density differential along with an ascending lift that sucks liquid into a liquid suction conduit wherein the liquid discharges into the fluid conveyance conduit. The ascending gas and liquid are discharged from the fluid conveyance conduit, allowing liquid to be introduced into both the storage and transfer housings thereby temporarily interrupting any further transfer of gas into the fluid conveyance conduit such that an intermittent cycling of fluid is established.

5 Claims, 7 Drawing Sheets

(56) References Cited

U.S. PATENT DOCUMENTS

| | | | | |
|---|---|---|---|---|
| 5,156,742 | A | 10/1992 | Struewing | |
| 6,162,020 | A | 12/2000 | Kondo | |
| 6,234,761 | B1 * | 5/2001 | Kocsis | E21B 43/121 417/118 |
| 6,641,733 | B2 * | 11/2003 | Zha | B01D 63/02 210/150 |
| 7,600,741 | B2 | 10/2009 | Lipert | |
| 8,047,808 | B2 | 11/2011 | Kondo | |
| 8,372,276 | B2 | 2/2013 | Zha et al. | |
| 2007/0166171 | A1 * | 7/2007 | Kondo | F04F 1/18 417/118 |
| 2010/0300968 | A1 * | 12/2010 | Liu | B01D 61/18 210/636 |
| 2011/0100907 | A1 * | 5/2011 | Zha | B01D 63/024 210/615 |
| 2011/0198283 | A1 * | 8/2011 | Zha | B01D 63/024 210/626 |
| 2012/0285885 | A1 * | 11/2012 | James | B01D 63/02 210/636 |
| 2014/0158618 | A1 * | 6/2014 | Zha | B01D 63/024 210/636 |
| 2014/0246104 | A1 | 9/2014 | Kondo | |

* cited by examiner

INTERMITTENT FLUID PUMP

FIELD

The present disclosure relates to an apparatus that intermittently introduces a compressible fluid (gas) into an incompressible fluid (liquid) thereby converting potential energy into kinetic energy. The compressible fluid provides the force (pressure) to move the incompressible fluid for the purpose of intermittently pumping fluid comprising of a volume of gas and a volume of liquid.

BACKGROUND

Whenever a compressible fluid such as gas is introduced within an incompressible fluid such as liquid gas bubbles are formed.

Gas bubble forming devices can be used in various ways for different applications and typically function via the introduction of a continuous flow of gas directed into; 1) a vertical column having an open upper end and most often an open bottom end, these are typically termed as a static tube aerator; 2) a distribution manifold or diffuser comprising of orifices; 3) a venturi type fixture that functions with a continuous flow of pressurized liquid moving through a restriction generating a slight vacuum that can draw gas into the liquid thereby forming gas bubbles to be entrained within the liquid and released into the bulk liquid.

The gas bubbles once released into the liquid will change the density of the liquid within the area of discharge and thereby provide a means for generating a flow and or mixing the liquid as is the case of a static tube type process. In addition gas can be distributed via a diffuser or a venturi fixture for transferring gas such as oxygen into the liquid as well as for mixing the liquid and its contents.

Prior art devices that operate with a continuous flow of gas for the purpose of pumping liquid via an 'airlift' process are inefficient since they have a small lift capacity and suction or flow velocity as compared to mechanical pumping devices. Therefore, their use is limited to pumping liquid only vertically a short height above the liquid surface level. The limited suction or flow velocity can further lead to clogging problems, when continuous gas flow 'airlift' type pumps are applied within liquid containing particulates or sludge.

Improvements with respect to the continuous gas flow 'airlift' process employed for the purpose of pumping liquid and most specifically transferring a liquid out from a body of liquid have recently been introduced.

U.S. Pat. No. 6,162,020 by Masao Kondo discloses an airlift pump apparatus and method that injects air intermittently into a vertical riser.

U.S. Pat. No. 8,047,808 by Masao Kondo discloses a 'geyser pump' for vertically moving a liquid upward.

The intermittent fluid pump of the current invention provides several improvements over prior art intermittent 'airlift' and 'geyser' pumps. Additionally disadvantages apparent with prior art continuous flow gas bubble forming devices currently employed for mixing and distributing liquid can be overcome with the use of the intermittent fluid pump, which can provide greater energy value, application adaptability and reduced maintenance requirements.

SUMMARY

A compressible fluid, such as gas, is introduced into a fluid storage housing containing an incompressible fluid, such as liquid, wherein the gas forces the liquid to flow downward into a fluid transfer housing positioned within the fluid storage housing. A fluid transfer passage directs liquid from the transfer housing into a vertical oriented fluid conveyance conduit until the liquid is fully transferred at which point the gas transfers into vertical oriented fluid conveyance conduit. As part of one embodiment the transferred gas generates a large gas bubble creating a density differential within the vertical oriented fluid conveyance conduit thereby generating a forceful ascending lift. The ascending lift sucks liquid into a liquid suction conduit such that liquid is directed into the vertical oriented fluid conveyance conduit. As liquid and gas are discharged from the vertical oriented fluid conveyance conduit liquid is introduced into the storage and transfer housings temporarily interrupting the transfer of gas whereby the intermittent cycling of fluid is established.

The intermittent fluid pump can be incorporated within the field of wastewater treatment, as well as many other fields of application such as, but not limited to, aquaculture, vegetative wetlands, ponds and hydroponics.

BRIEF DESCRIPTION OF DRAWINGS

These and other features will become more apparent from the following description in which reference is made to the appended drawings, the drawings are for the purpose of illustration only and are not intended to be in any way limiting, wherein.

DETAILED DESCRIPTION

Figure 1A:
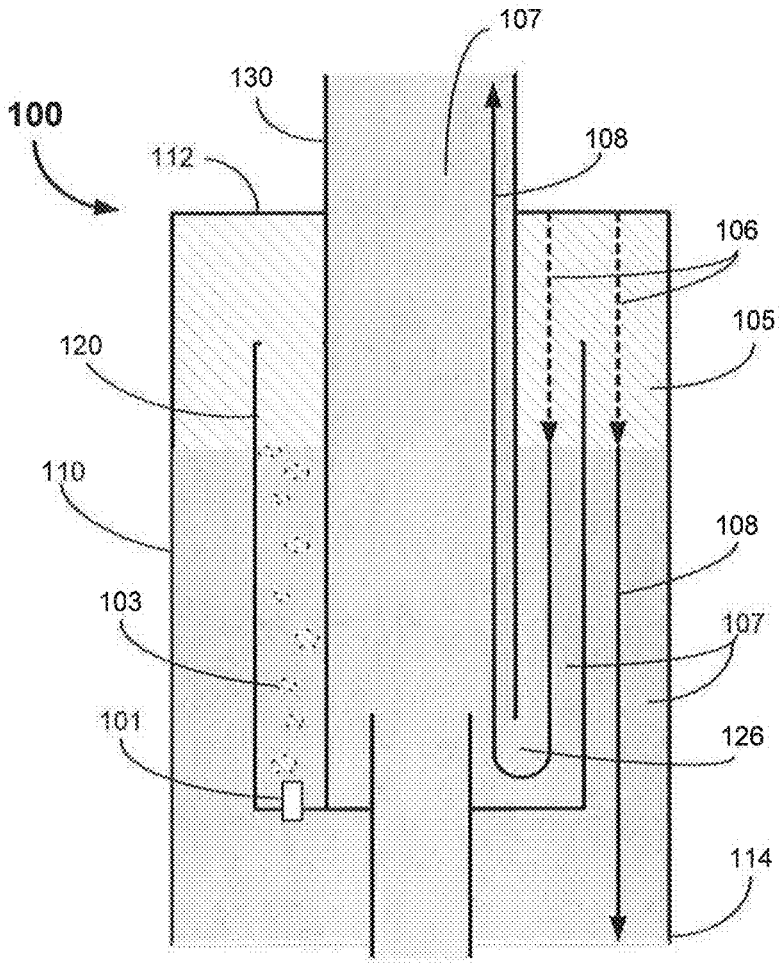
FIG. 1A is a side elevation view, in section, of an intermittent fluid pump in a first phase of operation.

FIG. 1A illustrates the first phase of operation of the intermittent fluid pump 100 when submerged within a body of liquid (not illustrated) wherein a gas is introduced into a fluid storage housing 110 via a gas intake 101 forming gas bubbles 103 to ascend through liquid 107 contained within fluid storage housing 110 thereby generating a volume of gas 105 at the upper closed end of fluid storage housing 110.

As the volume of gas 105 expands downward, as indicated with doted directional arrows 106, it displaces the liquid 107 thereby forcing the liquid to flow downward, as indicated by solid directional arrows 108, out from bottom end 114 of the fluid storage housing 110 and simultaneously out of a fluid transfer housing 120 into a vertically oriented fluid conveyance conduit 130 via a fluid transfer passage 126.

Figure 1B:
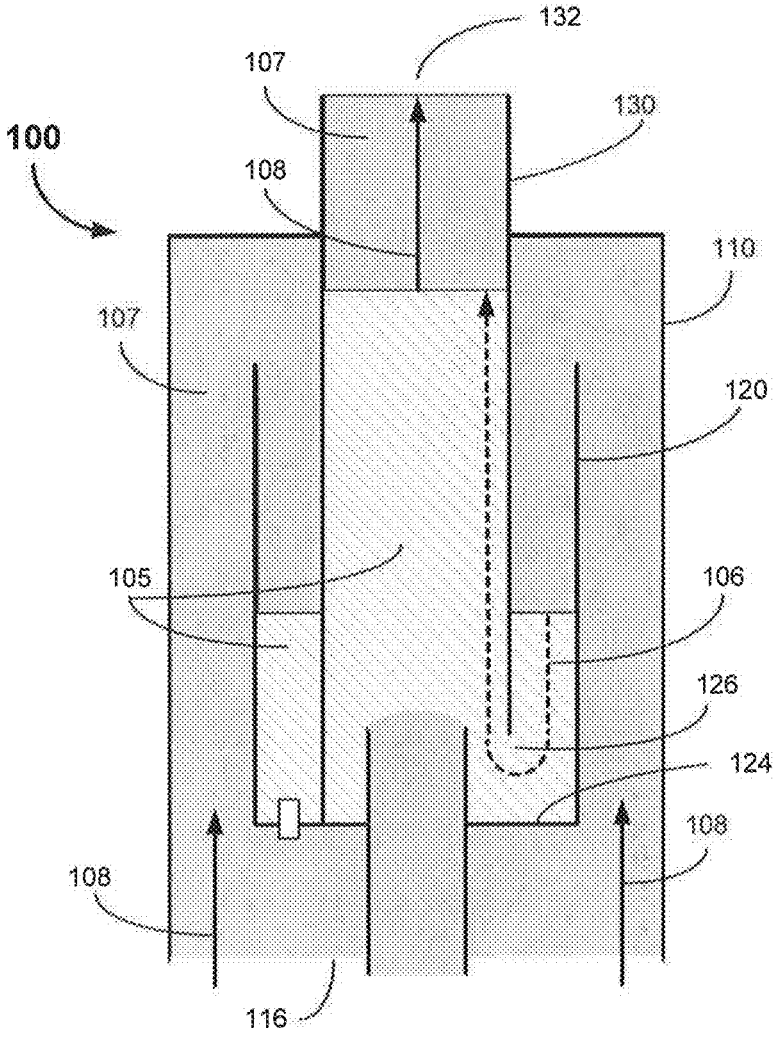
FIG. 1B is a side elevation view, in section, of the intermittent fluid pump of in a second phase of operation.

FIG. 1B illustrates the second phase of operation of the intermittent fluid pump 100 wherein the gas volume 105 has displaced the volume of liquid 107 within transfer housing 120 into fluid conveyance conduit 130, as indicated via doted arrows 106 wherein the gas volume 105 begins to enter fluid conveyance conduit 130 via fluid transfer passage 126 positioned adjacent to closed bottom end 124 of fluid transfer housing 120.

The introduction of the transferred gas volume 105 into fluid conveyance conduit 130 creates a density differential wherein the volume of gas 105 begins to ascend within the fluid conveyance conduit 130 thereby forcing liquid 107 to discharge from discharge end 132 of fluid conveyance conduit 130 as indicated with solid arrow 108.

The density differential generated via the ascending gas 105 within fluid conveyance conduit 130 draws liquid 107 into fluid storage housing 110, as indicated by arrows 108, via liquid influent opening 116. As the inflowing liquid 107 fills the fluid storage housing 110 and the fluid transfer housing 120 it forces remaining gas volume 105 into fluid conveyance conduit 120.

Figure 1C:
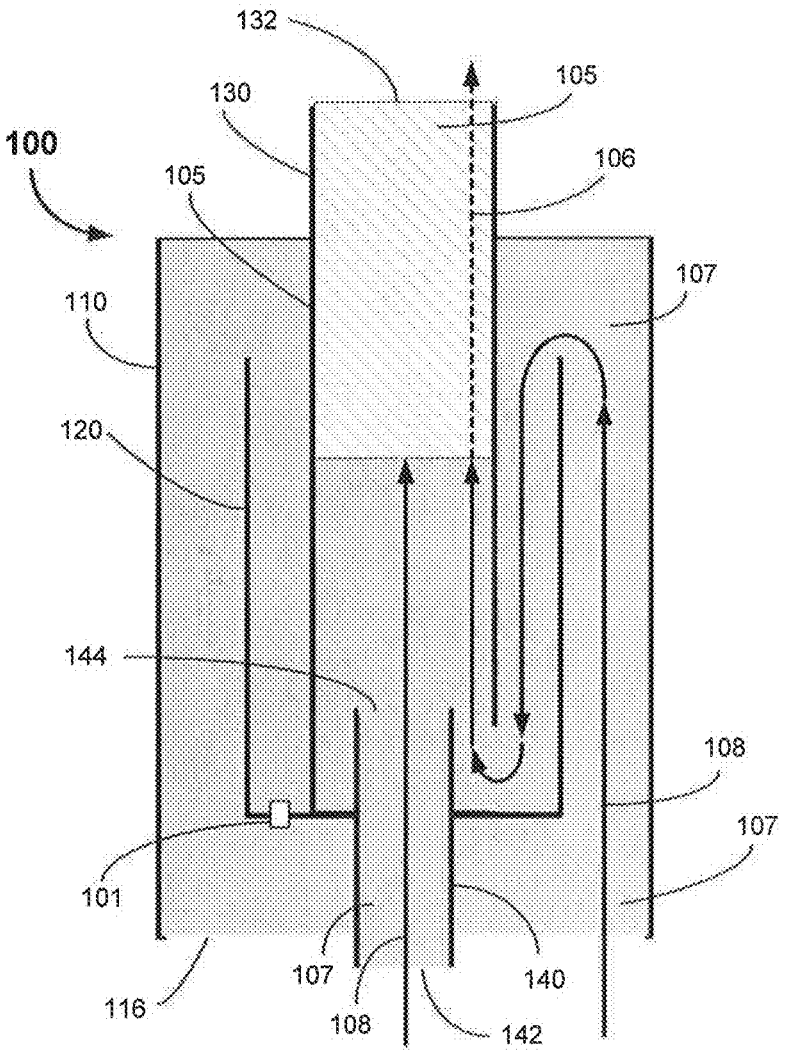
FIG. 1C is a side elevation view, in section, of the intermittent fluid pump of in a third phase of operation.

FIG. 1C illustrates the third phase of operation of the intermittent fluid pump 100 wherein liquid volume 107 forces gas volume 105 to be transferred into vertical oriented fluid conveyance conduit 130, as indicated by solid arrow 108 wherein the density differential generated via ascending gas 105 allows liquid to enter into liquid suction conduit 140 via inlet end 142 wherein liquid 107 is discharged from outlet end 344 of liquid suction conduit 130.

The discharge of fluid from discharge end 132 of fluid conveyance conduit 130 enables the introduction of liquid 107 into both fluid storage housing 110 and fluid transfer housing 120 thereby displacing the volume of gas 105 with the volume of liquid 107 temporally interrupting any further transfer of gas into fluid conveyance conduit 120 thereby establishing the intermittent cycling of fluid.

Figure 1D:
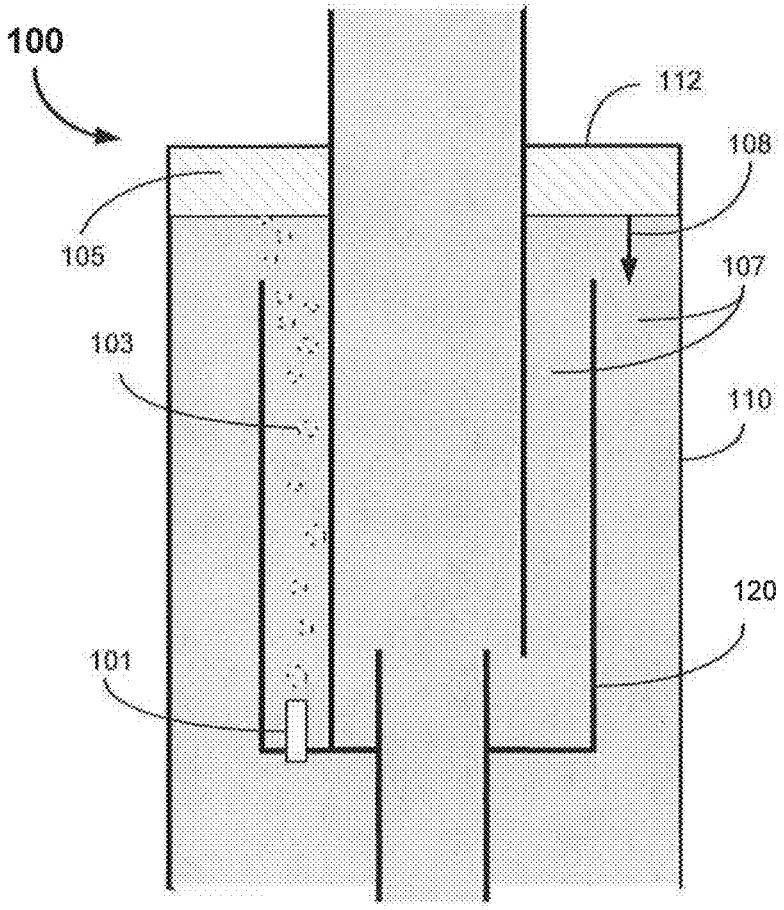
FIG. 1D is a side elevation view, in section, of the intermittent fluid pump of in a fourth phase of operation.

FIG. 1D illustrates the fourth phase of operation of the intermittent fluid pump having fluid storage housing 110 and fluid transfer housing 120 filled with liquid 107 wherein gas introduced into storage housing 110 via gas intake 101 ascends as gas bubbles 103 forming a volume of gas 105 at upper closed section 112 of fluid storage housing 110 thereby forcing liquid 107 to flow downward as indicated by solid arrow 108 thus beginning phase one of the intermittent fluid cycling process.

Figure 2:
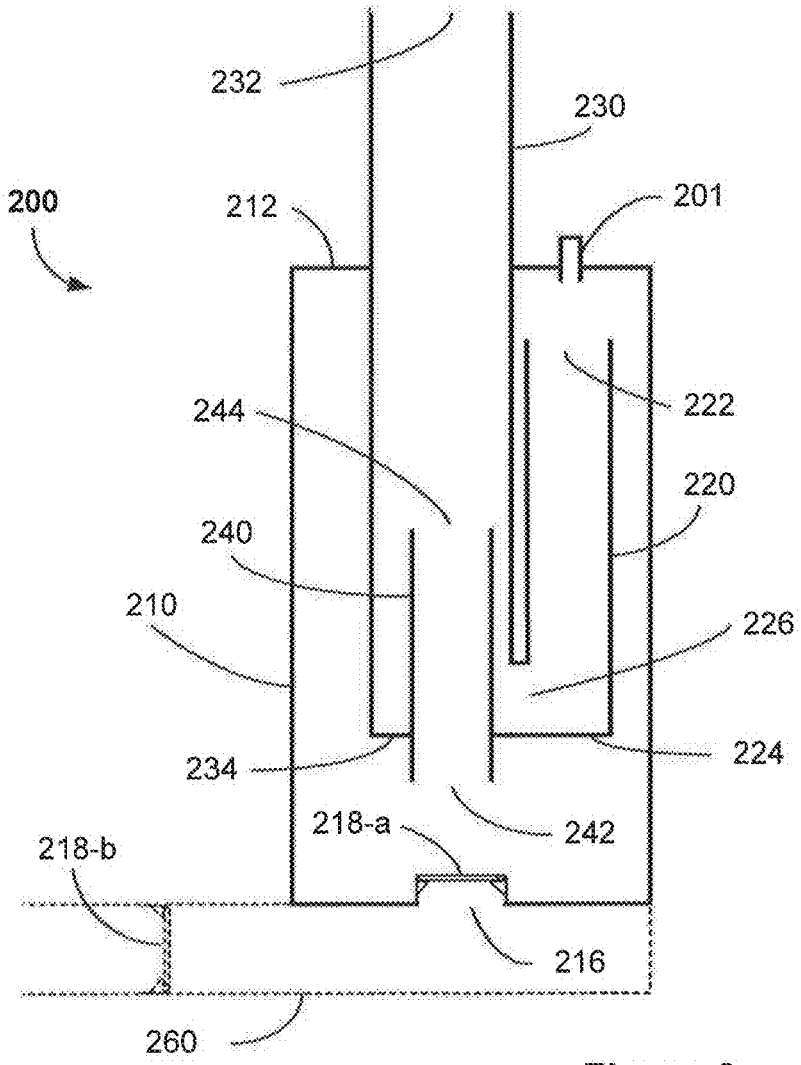
FIG. 2 is a side elevation view, in section, illustrating an embodiment of the intermittent fluid pump having a flow control device such as but limited to a check valve incorporated into liquid influent opening of fluid storage housing or optionally incorporated into a liquid input conduit, shown as dotted lines. A vertically oriented fluid conveyance conduit passing through closed upper end of fluid storage housing, lower end of fluid conveyance is located within the fluid storage housing and positioned outside of a fluid transfer housing. Fluid transfer housing is in communication with fluid conveyance conduit via a fluid transfer passage positioned adjacent bottom end of the fluid transfer housing. A liquid suction conduit passes through closed lower end of fluid conveyance conduit.

FIG. 2 illustrates an embodiment of intermittent fluid pump 200 that functions under the same basic operational phases as described and illustrated with FIGS. 1A through 1D, wherein gas intake 201 passes through upper closed end 212 of fluid storage housing 210.

Liquid influent opening 216 incorporates a flow-controlling device 218-*a*. The flow-controlling device 218-*a* can be but not limited to a check valve or solenoid valve and be incorporated into liquid influent opening 216. As an alternative variant, illustrated with doted lines, a liquid input conduit 260 that directs liquid flow into liquid influent 215 can be equipped with a flow-controlling device 218-*b*.

Fluid storage housing 210 incorporates a vertically oriented fluid conveyance conduit 230 positioned outside of fluid transfer housing 220 and passing through upper closed end 212 of fluid storage housing 210.

Fluid transfer housing 220 is in connected to fluid conveyance conduit 230 via fluid transfer passage 226 passing through sidewall near closed bottom end 224 of fluid transfer housing 220 and sidewall near closed lower end 234 of fluid conveyance conduit 230 wherein fluid transfer passage 226 transfers fluid from fluid transfer housing 220 into fluid conveyance conduit 230.

A liquid suction conduit 240 including an outlet end 244 and an inlet end 242 passes through closed lower end 234 of fluid conveyance conduit 230 wherein outlet end 244 is positioned above fluid transfer passage 224. Liquid suction 240 directs liquid to be discharged into fluid conveyance conduit 230.

Figure 3:
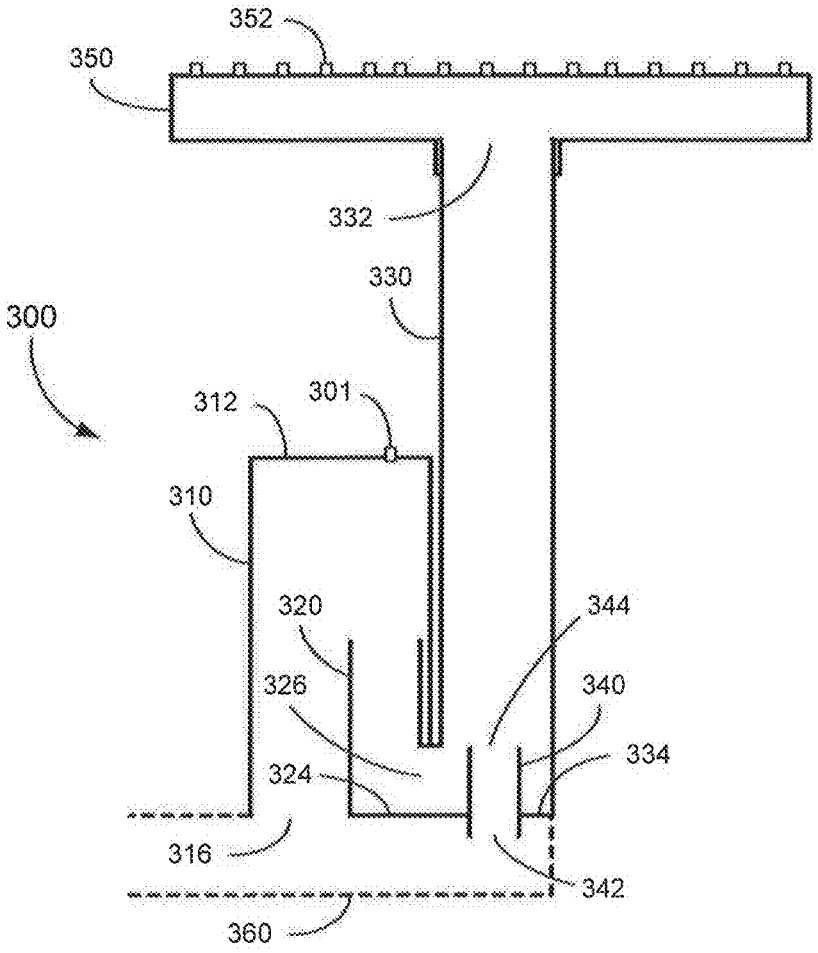
FIG. 3 is a side elevation view, in section, illustrating an embodiment of intermittent fluid pump wherein the discharge end of fluid conveyance conduit is connected to a distribution manifold. Fluid conveyance conduit is positioned outside of a fluid storage housing and connected to fluid transfer housing located within fluid storage housing via a fluid transfer passage. A liquid suction conduit passes through a closed lower end of fluid conveyance conduit. Also illustrated, with dotted lines, is the option of incorporating a liquid input conduit.

FIG. 3 illustrates another embodiment of intermittent fluid pump 300 that functions under the same basic operational phases as described and illustrated with FIGS. 1A through 1D, wherein gas intake 301 passes through upper closed end 312 of fluid storage housing 310.

Fluid transfer housing 320 housed within fluid storage housing 310 is connected to fluid transfer passage 326 adjacent to closed bottom end 324 of fluid transfer housing 320.

Fluid transfer passage 326 passes through sidewall of fluid storage housing 310 and sidewall near closed lower end 334 of vertically oriented fluid conveyance conduit 330. Fluid transfer passage 326 directs fluid to be transferred from transfer housing 320 into fluid conveyance conduit 330 that is positioned outside of fluid storage housing 310.

A liquid suction conduit 340 having an inlet end 342 and an outlet end 344 passes through closed lower end 334 of fluid conveyance conduit 330 wherein outlet end 344 is positioned above fluid transfer passage 326.

As an option, illustrated within this embodiment and also possible with other embodiments, fluid conveyance conduit discharge end 332 is in communication with a fluid distribution manifold 350 incorporating orifices 352.

Additionally as a variant illustrated within this embodiment and equally adapted to other embodiments of the intermittent fluid pump, is the ability to incorporate a liquid input conduit 360, illustrated with dotted lines, wherein liquid influent opening 316 and inlet end 342 of liquid suction conduit 340 can access liquid from liquid input conduit 360.

The use of a liquid input conduit as described can allow for a number of options. As for one example liquid can be introduced within the intermittent fluid pump that originates from a separate body of liquid than that of the liquid the intermittent pump is located within.

Figure 4:
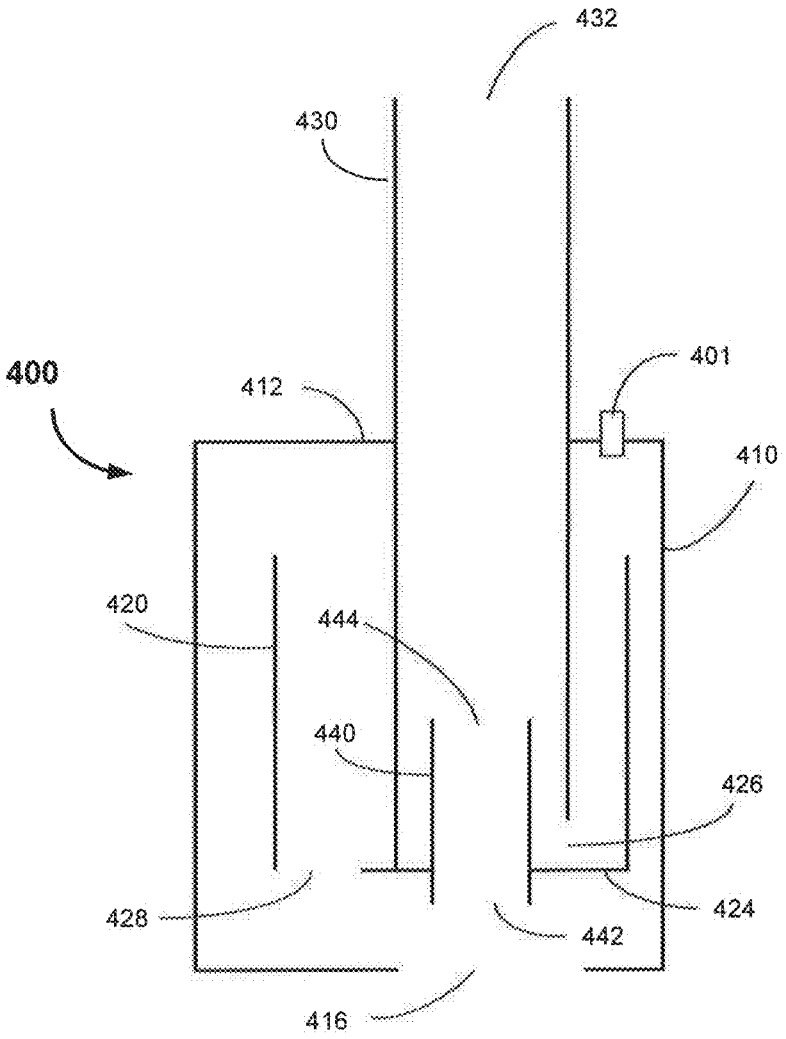
FIG. 4 is a side elevation view, in section, illustrating another embodiment of intermittent fluid pump wherein closed bottom end of a fluid transfer housing incorporating an opening positioned at a distance lateral of a liquid suction conduit that is passing through closed bottom end of transfer housing.

FIG. 4 illustrates another embodiment of intermittent fluid pump 400 that functions under the same basic operational phases as described and illustrated with FIGS. 1A through 1D.

Gas intake 401 and vertically oriented fluid conveyance conduit 430 pass through upper closed end 412 of fluid storage housing 410 wherein upper discharge end 432 of fluid conveyance conduit 430 is positioned a distance above fluid storage housing 420 and lower end 434 of fluid conveyance conduit 430 is positioned near bottom end 424 of fluid transfer housing 420.

A liquid suction conduit 440 having an inlet end 442 and an outlet end 444 passes through closed bottom end 424 of fluid transfer housing 420 and is positioned at a lateral distance from opening 428 passing through bottom end 424 of fluid transfer housing 420.

The embodiment as described above is designed to discharge large bubbles directly into the bulk liquid. The large bubbles, which tend to flatten as they ascend, create a strong lifting wake. The embodiment is designed for applications not requiring pumping of fluids to any significant lift height or a high flow velocity through the fluid conveyance conduit therefore the incorporation of an opening passing through the bottom end of the transfer housing and as part of one variant positioned at a lateral distance from the liquid suction conduit, enables a faster exchange of fluids through the transfer housing and prevents any possibility of clogging from the introduction of particulates.

The energetic action that the intermittent fluid pump generates within a body of liquid is dramatically different then prior art bubble forming devices operating under continuous flow. The intermittent cycling of the fluid pump provides a pulsating suction and expulsion force, analogous to inhaling and exhaling or the action of a piston wherein the liquid is the piston and the gas is the applied energy force. This energetic pulsating action is transferred to the body of liquid thereby allowing particles to move as tidal flow rather than strictly a unidirectional flow.

The rate of gas flowing into the housings of the intermittent fluid pump and the fluid volumetric size of the housings governs the sequencing time of intermittent cycling and the volumetric flow of fluid per each cycle. Controlling the volume and the discharge flow rate via a controllable gas flow valve, or other controllable means, allows for greater energy efficiency, process functionality and mixing control. When incorporated in combination with movable biofilm substratum the controllable rate of gas flow enables a method of customizing the throughput rate of the biofilm substratum into and out of the intermittent fluid pump. This same controllable gas flow feature provides customized fluid flow throughput and bubble volume when the intermittent pump is operated in combination with other biofilm supported substratum types.

The fluid mechanics of the intermittent fluid pump provides numerous improvements over prior art by allowing, as related to one of the embodiment, the majority of the gas volume introduced within the housings to be transferred into the vertical oriented fluid conveyance conduit. The transfer of gas generates the formation of a gas bubble having a large gas volume that can displace an equal volume of liquid within the vertical oriented fluid conveyance conduit allowing an increased hydrodynamic density differential potential to develop thereby generating higher lift or discharge height above a liquid surface level and also greater velocity of flow.

The ability to design the intermittent fluid pump to discharge a gas volume similar to the volume occupied by liquid within the vertical oriented fluid conveyance conduit allows customization of the intermittent fluid pump ensuring maximum benefit of this unique function. The introduction of a separate liquid suction conduit is a key component that differentiates over prior art and provides for several improvements. The liquid suction conduit can be custom designed to meet various bubble formation and fluid flow needs. The outlet end of the liquid suction conduit can be posited proximal to lower end or partially housed within vertical oriented fluid conveyance conduit wherein the outlet is positioned above the fluid transfer passage. The design of fluid suction conduit with outlet end positioned above fluid transfer passage allows for a brief residence time wherein the numerous gas bubbles that are generated when the volume of gas is transferred into the vertical oriented fluid conveyance conduit to coalesce into a large gas bubble.

The capability of the intermittent fluid pump to access the majority of the gas volume introduced into the storage and transfer housings is a significant improvement over prior art U.S. Pat. No. 6,162,020 wherein the 'discharge port' provides the introduction of gas bubbles into the 'riser tube'. The positioning of the 'discharge port' above the 'intake port' of the 'riser tube' prevents the full flow of gas volume to be released into the 'riser tube' wherein a portion of the liquid entering into the 'riser tube' is of a slightly greater pressure then the gas pressure thereby liquid flows into the 'discharge port' preventing the full volumetric flow of gas available to be discharged and thereby limiting the volumetric value of gas bubbles present within the 'riser tube'.

The positioning of the liquid suction conduit of the intermittent fluid pump can provide a straight unimpeded flow for liquid as well as for liquid comprising particulate matter, movable or granular type biofilm support substratum to freely move through the vertical oriented fluid conveyance conduit. The introduction of an opening, as part of one embodiment, within the closed bottom end of fluid transfer housing eliminates the possibility of clogging with particulate matter. These features as described above provide improvements with respect to prior art U.S. Pat. No. 8,047,808 that incorporates a 'U shaped tube'. The positioning of the 'U-tube' within the 'riser tube' creates an obstruction to the incoming flow into the 'riser tube' in addition U.S. Pat. No. 8,047,808 includes a second air supply that introduces gas bubbles into the 'U-tube' in order to keep particulate matter from accumulating within the 'U-tube' as well as to keep particulates in suspension within the 'riser tube', thereby requiring the addition of more air and therefore greater energy consumption just to keep the 'geyser pump' from becoming compromised.

The incorporation of a flow controlling device such as a check valve or solenoid valve incorporated within the liquid influent opening or within a liquid input conduit provides support for controlling the input gas pressure and thereby providing lifting liquid to greater height or discharging fluid into a pressurized container. The feature of lifting liquid to greater height, as for one example, can be achieved by utilizing the volume of liquid within the fluid conveyance conduit that is above the volume of gas within the fluid conveyance conduit to determine the input gas pressure requirement for the flow of fluid.

When the flow control device is in a closed position the liquid that is being displaced and moving downward within the fluid storage housing is directed into vertical oriented fluid conveyance conduit wherein the height or depth of the liquid within the conveyance conduit determines the gas pressure required to move liquid upward and finally discharged. Once the liquid volume is discharged and the gas also begins to be discharged the pressure within the fluid storage housing is reduced allowing the flow control device to open and liquid to enter and fill the storage and transfer housings.

The feature of incorporating a flow control device is a unique improvement over continuous flow type 'airlift' pumps that do not have the capacity to control the input gas pressure.

Having a gas intake placement that is not limited to only the upper portion of storage housing and the ability to introduce more than one liquid input flow into the intermittent fluid pump allows additional improvements and better design flexibility over prior art.

In operation for an example within the field of wastewater treatment, the intermittent fluid pump can operate in combination with biofilm support substratum thereby providing multiple benefits and improvements. This is accomplished via the intermittent fluid discharge cycling, which can generate a wave like motion across a biofilm surface enhancing gas diffusion flux within the bioflim matrix. The ability to form a large gas bubble having a large suction wake can provide greater flow throughput, as for example across a membrane when used together with a membrane biofilm reactor, by drawing off excessive biofilm growth buildup upon the membrane. When operated in combination with small movable biofilm substratum the increase flow velocity and lift from the intermittent fluid pump allows the circulation of the movable biofilm substratum to flow through the intermittent fluid pump and discharge from the discharge conveyance conduit back into the upper level of or out of the liquid. The movement of the movable biofilm support substratum out of the liquid provides greater contact with atmospheric gas wherein applications supporting an aerobic treatment process can be enhanced as well as conserving energy.

The intermittent fluid pump can be operated independently, in combination with a fluid distribution manifold, and or a gas diffuser, to distribute fluid out of or within a body of liquid as well as but not limited to directing fluid flow throughout biofilm support substratum and biofilm membrane reactors.

Several improvements are encompassed within the intermittent fluid pump thereby achieving greater performance efficiency, energy conservation and process adaptability. It therefore is apparent that the advantages as described herein provide multiple improvements over prior art.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. Intermittent fluid pump comprising of:

a fluid storage housing includes a peripheral sidewall and an upper end defining an interior, with a liquid influent opening at or near a bottom end, the upper end being closed except for the passing through of a vertically oriented fluid conveyance conduit having a lower end that is positioned within the fluid storage housing and an upper discharge end positioned outside of the fluid storage housing and a gas intake for introduction of gas into the interior of the storage housing such that gas accumulates at the upper end;

a fluid transfer housing positioned inside the fluid storage housing, the fluid transfer housing having an open upper end and a closed bottom end;

a fluid transfer passage adjacent to the closed bottom end of the fluid transfer housing providing transfer of fluid into the lower end of the fluid conveyance conduit; and a liquid suction conduit having an inlet end and an outlet end, the outlet end being positioned within the lower end of the fluid conveyance conduit such that liquid is directed through the liquid suction conduit into the conveyance conduit.

2. Intermittent fluid pump of claim 1 wherein the outlet end of the liquid suction conduit extends above the fluid transfer passage.

3. Intermittent fluid pump of claim 1 wherein the liquid flow entering into the influent opening at or near the bottom end of the fluid storage housing is controlled via a flow-controlling device.

4. Intermittent fluid pump of claim 1, wherein the lower end of the fluid conveyance conduit is closed except for the passage of the liquid suction conduit therethrough.

5. Intermittent fluid pump of claim 4, wherein the fluid conveyance conduit is adjacent to the fluid transfer housing and the closed lower end of the fluid conveyance conduit is co-planar with the closed bottom end of the fluid transfer housing.

* * * * *